US007834839B2

(12) United States Patent
Muto et al.

(10) Patent No.: US 7,834,839 B2
(45) Date of Patent: Nov. 16, 2010

(54) IMAGE DISPLAY DEVICE AND IMAGE DISPLAY METHOD

(75) Inventors: Kota Muto, Suwa (JP); Munenori Sawada, Suwa (JP)

(73) Assignee: Seiko Epson Corporation (JP)

( * ) Notice: Subject to any disclaimer, the term of this patent is extended or adjusted under 35 U.S.C. 154(b) by 655 days.

(21) Appl. No.: 11/695,172

(22) Filed: Apr. 2, 2007

(65) Prior Publication Data

US 2008/0036727 A1 Feb. 14, 2008

(30) Foreign Application Priority Data

Apr. 3, 2006 (JP) ..... 2006-101947
Mar. 19, 2007 (JP) ..... 2007-069897

(51) Int. Cl.
*G09G 3/36* (2006.01)

(52) U.S. Cl. ..... 345/101; 345/87; 345/89; 345/690

(58) Field of Classification Search ..... 345/55–107, 345/204–214, 690–697
See application file for complete search history.

(56) References Cited

U.S. PATENT DOCUMENTS 5,748,277 A 5/1998 Huang
6,496,170 B1 * 12/2002 Yoshida et al. ..... 345/87
6,670,937 B1 * 12/2003 Tsuboyama et al. ..... 345/97
6,803,899 B1 * 10/2004 Masazumi et al. ..... 345/101
7,038,647 B2 * 5/2006 Shigeta et al. ..... 345/89
7,274,348 B2 * 9/2007 Izumi et al. ..... 345/87
7,358,948 B2 * 4/2008 Shiomi et al. ..... 345/89
7,420,538 B2 * 9/2008 Murao et al. ..... 345/101
2003/0179175 A1 * 9/2003 Shigeta et al. ..... 345/101
2006/0022926 A1 * 2/2006 Mizumaki et al. ..... 345/89
2006/0139295 A1 * 6/2006 Eberhard et al. ..... 345/101
2006/0158410 A1 * 7/2006 Fujine ..... 345/89
2008/0246903 A1 * 10/2008 Park et al. ..... 345/101

* cited by examiner

*Primary Examiner*—David L Lewis
(74) *Attorney, Agent, or Firm*—Harness, Dickey & Pierce, P.L.C.

(57) ABSTRACT

An image display device for displaying an image on a display panel is provided. The image display device includes a temperature variation rate detecting unit that detects a temperature variation rate of the display panel; a driving condition setting unit that sets driving conditions so as to display the image on the display panel in accordance with an image data of the image; a driving condition changing unit that changes the set driving conditions in accordance with the detected temperature variation rate; and a display panel driving unit that displays the image on the display panel by driving the display panel with the driving conditions changed by the driving condition changing unit.

14 Claims, 10 Drawing Sheets

IMAGE DISPLAY DEVICE AND IMAGE DISPLAY METHOD

BACKGROUND

1. Technical Field

The present invention relates to an image display device and an image display method, and more specifically, to a technique suitable for the image display device having a display panel with a large variation in characteristics due to a variation in temperature.

2. Related Art

In the past, in an image display device for displaying a variety of information as an image, the image display device having a memory type display panel was practically used. Since the memory type display panel consumes an electric power only during a rewriting operation, the power consumption is very small as compared with a general display panel. Therefore, since an apparatus having the image display device can be reduced in size by reducing a battery capacity, the memory type display panel comes into the spotlight as a display panel suitable for apparatuses such as an electronic book.

An example of the memory type display panel is a display panel using a cholesteric liquid crystal as a display material. When the cholesteric liquid crystal is used, it is possible to achieve a high-rate rewriting operation of an image by a DDS (Dynamic Drive Scheme) driving system as a driving system with a cholesteric liquid crystal disclosed in U.S. Pat. No. 5,748,277.

However, although the display material of the display panel having the memory characteristic has the advantage as mentioned above, there is a problem that a viscosity is likely to vary depending on a temperature. For this reason, the temperature compensating process should be normally performed. That is, for the temperature compensating process, a period applying the driving voltage pulse or applied voltage values and so on should be varied based on the measured temperature of the display material. In particular, when the cholesteric liquid crystal is driven by applying DDS driving system, it is necessary that the temperature compensating process should be performed in a step where temperature difference of 1° C. or less is a prescribed width. In particular, it is required that the temperature compensating process is strictly performed when a gradation display is realized by plural levels.

Meanwhile, when the temperature of the display material is measured, the temperature is measured via members (glass, plastic, etc.) interposing the display material. Therefore, it occurs that the temperature at measuring point is different from the temperature of the display panel itself. In particular, when an ambient temperature of the display panel is varied as time goes on, a lot of time deviation occurs until the temperature of the display material reaches the measured temperature. Therefore, the temperature difference occurs between the measured temperature and the temperature of the display material at time of actual driving. In particular, the temperature difference is great when the environmental temperature of the display panel is rapidly varied, for example when the display panel is moved from the cold outdoors to the warm indoors. Therefore, there is a problem that the temperature compensating process cannot be sufficiently performed only on the base of values of the measured temperature.

SUMMARY

An advantage of some aspects of the invention is that it provides an image display device and an image display method capable of performing a temperature compensating operation with high precision when an ambient temperature of a display panel is sharply varied.

According to a first aspect of the invention, there is provided an image display device for displaying an image on a display panel, and the device includes a temperature variation rate detecting unit that detects a temperature variation rate of the display panel; a driving condition setting unit that sets driving conditions so as to display the image on the display panel in accordance with an image data of the image; a driving condition changing unit that changes the set driving conditions in accordance with the detected temperature variation rate; and a display driving unit that displays the image on the display panel by driving the display panel with the driving conditions changed by the driving condition changing unit.

According to this configuration, for example, even when the sufficient temperature compensating process of the display is not performed only by setting the driving conditions based on the measured temperature, it is possible to perform an additional temperature compensating process based on variation with time of the measured temperature, that is, the temperature variation rate. Accordingly, even in case where the temperature of the display material itself is not measured, the temperature compensating process of higher precision can be achieved. In addition, the driving conditions according to the first aspect of the invention means the condition for determining at least an applied time or an applied voltage value of the driving voltage pulse applied to each pixel of the display panel. In addition, the change of the driving conditions according to the first aspect of the invention includes a reset of the driving condition similar to the set driving condition.

The driving condition changing unit may change the driving conditions during driving of the display panel.

For example, when the temperature variation rate of the display panel is rapid and much time elapses after beginning the driving of the display panel on which one image is displayed, the temperature difference of the display panel between the display beginning and the display ending is large and thus the image is not correctly displayed. Here, when the driving condition is changed while driving the display panel, it is possible to display the image with the driving condition adapted to the real temperature of the display panel during driving. As a result, the temperature compensating process of higher precision can be achieved.

The image display device may farther include a gradation setting unit that sets so as to change an image gradation value as an image data of a pixel configuring the image into a display gradation value as an image data of a pixel configuring the image displayed by the display panel driving unit in accordance with the detected temperature variation rate. In this case, the driving condition changing unit may change the set driving conditions into the driving conditions on which the driving condition setting unit sets the changed and set display gradation value as an image data.

According to this configuration, the gradation value (pixel gradation value) of the pixel forming the image for displaying on the display panel is changed and converted into the gradation value (display gradation value) of the pixel forming the real image to be displayed in accordance with the temperature variation rate, and the display panel is driven with the driving condition based on the image data of the converted display gradation value. Accordingly, the image to be actually displayed is temperature-compensated by the converted display gradation value in accordance with the temperature variation rate. For this reason, the temperature compensating process having good precision can be achieved.

When the temperature variation rate exceeds a threshold value, the gradation setting unit may change and set the pixel gradation value to the display gradation value so that the number of gradation display of the image to be displayed is small as compared that in case where the temperature variation rate is not more than the threshold value.

When the temperature variation rate exceeds the threshold value, as described below there may be, the case where it is difficult to conduct the gradation display of the image to be originally displayed. To cope with this the number of gradation display is decreased such that two gradations of, for example, white or black are displayed. Accordingly, since the halftone (for example, gray) is changed into the black or white in advance, for example, one character is prevented from becoming thick or thin. Therefore, it is possible to display the stable image without being affected by the temperature variation.

The gradation setting unit may change and set the pixel gradation value to the display gradation value on the basis of a table that prescribes a correspondence relationship between the pixel gradation value and the display gradation value.

According to this configuration, the pixel gradation value can be easily changed and set into the display gradation value based on the table in accordance with the temperature gradient showing the temperature variation rate. As a result, this can improve a phenomenon that the screen of display panel becomes excessively dark or bright as a whole, and thereby the temperature compensating process with respect to the temperature variation can be performed with good precision.

When the temperature variation rate exceeds a threshold value, the gradation setting unit may set a display gradation value that differs from the display gradation value when the temperature variation rate is not more than the threshold value.

According to this configuration, when the temperature variation rate exceeds the threshold value, it is suggested that the temperature difference between the temperature at measuring point and the temperature of display material becomes large. In this case, driving condition is changed by varying the display gradation values. This can improve a phenomenon that the screen of display panel becomes excessively dark or bright as a whole, and thereby the temperature compensating process with respect to the temperature variation can be performed with good precision.

Here, the image display device may farther include an image generating unit that generates a changed pixel gradation value of which the pixel gradation value is changed such that the pixel gradation value is converted into a predetermined display gradation value. In this case, the gradation setting unit may change and set the changed pixel gradation value as the pixel gradation value.

This can allow the display gradation values, which are modified by a table depending on the temperature variation rate, as a predetermined display gradation value all the time. Therefore, since the driving condition driving the display panel is always the same condition, the temperature compensating process can be effectively performed when the number of kinds in the driving conditions is limited.

In addition, the image display device may further include a temperature measuring unit that measures a temperature of the display panel. In this case, the driving condition setting unit may set the driving conditions in accordance with the measured temperature of the display panel in addition to the image data.

This can allow the image display device to be driven on the driving condition depending on the temperature of the display panel. Accordingly, the temperature compensating process depending on the temperature of the display panel as well as depending on the temperature variation rate of the display panel is performed, and thereby the temperature compensating process can be realized with good precision.

The driving condition setting unit may set driving conditions on the basis of the image data from the driving conditions having the number not less than the number of gradation displays of the image displayed on the display panel.

This can allow the driving condition depending on the temperature variation rate to be set from a plurality of driving conditions depending on the display gradation values. Therefore, the temperature compensating process can be appropriately performed, and the temperature compensating process can be performed with better precision.

In this case, a display material of the display panel may be a liquid crystal material showing a plurality of final alignment states having different molecular alignments in a final image display state. The display panel driving unit may drive the display panel by using a driving system that selects the final alignment state in a selection period after transiting an alignment state of the molecular alignment into a transition alignment that differs from the final alignment state.

Furthermore, the display panel may utilize a cholesteric liquid crystal molecular as a display material.

For example, the DDS driving system of cholesteric liquid crystal mentioned above can be exemplified as the driving method. In this case, a transitional alignment condition is equivalent to homeotropic alignment. Thereafter, homeotropic alignment is changed into transitional planar alignment in a period for selecting final alignment condition (planar alignment or focal conic alignment). Since the transitional planar alignment can be changed in a short time, there is an advantage that the updating time can he greatly reduced. Meanwhile, since temperature controls whether the transitional planar alignment is changed or not, it is required that the temperature compensating process should be performed with high precision. Therefore, the present invention can be very effectively applied.

In addition, the cholesteric liquid crystal is a display material driven by the DDS driving system described above, and since the property of the cholesteric liquid crystal is largely varied due to the temperature variation, the cholesteric liquid crystal is very effective to the application of the invention.

According to another aspect of the invention, there is provided an image display method of displaying an image on a display panel. The method includes: detecting a temperature variation rate of the display panel; setting driving conditions so as to display the image on the display panel in accordance with an image data of the image; changing the set driving conditions in accordance with the detected temperature variation rate; and displaying the image on the display panel by driving the display panel with the driving conditions changed by the driving condition changing unit.

According to this configuration, it is possible to obtain the same advantages as the image display device of the aspect of the invention described above. Furthermore, this image display method may further include achieving the functions of the image display device described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Next, an image display device according to a first embodiment of the invention will be described in the following order:

(A) Functional configuration of an image display device;

(B) DDS driving system of a cholesteric liquid crystal;

(C) First example of temperature compensating process in this embodiment;

(D) Second example of temperature compensating process in this embodiment; and (E) Third example of temperature compensating process in this embodiment.

(A) Functional Configuration of an Image Display Device

Figure 1:
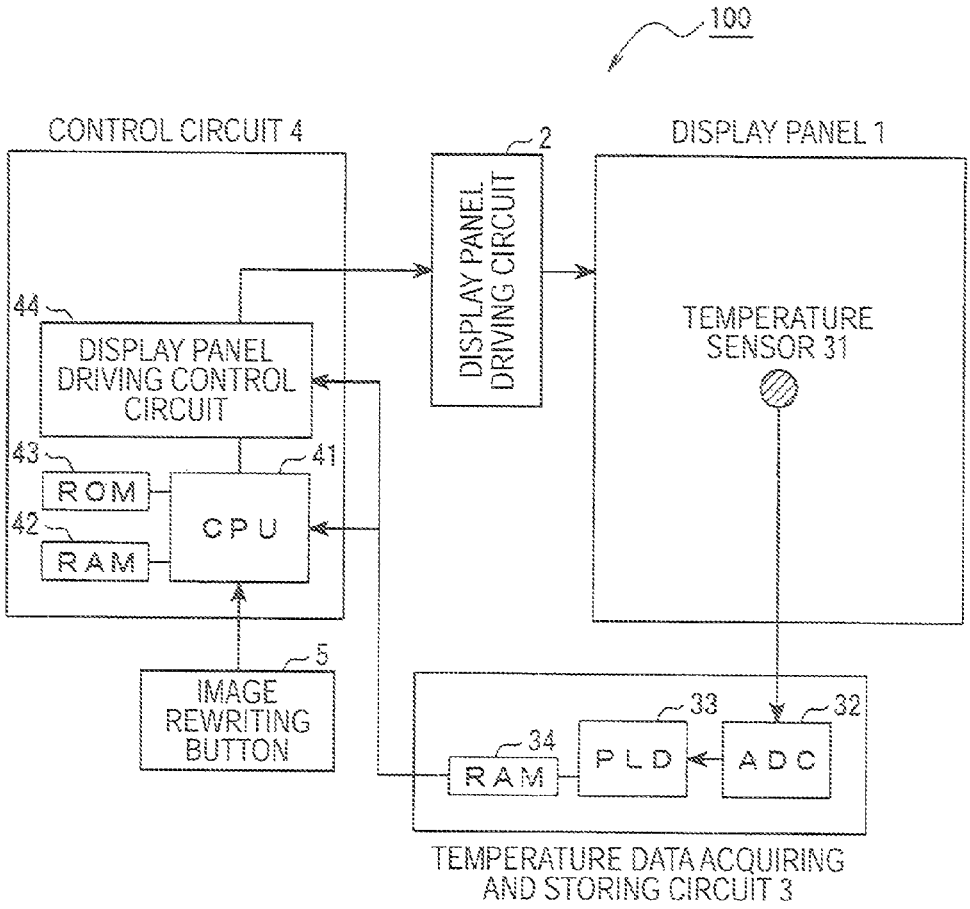
FIG. 1 is a block diagram showing an internal configuration of an image display device according to a first embodiment of the invention.

FIG. 1 is a block diagram showing a functional configuration of an image display device 100 according to an embodiment of the invention. As shown in FIG. 1, the image display device 100 is configured to have a display panel 1, a display panel driving circuit 2 driving the display panel 1 in a predetermined driving condition, a temperature data acquiring and storing circuit 3 acquiring and storing the temperature of the display panel 1, a control circuit 4 controlling the driving condition of the display panel 1, and an rewriting button 5 for rewriting images displayed on the display panel 1.

Figures 2A, 2B, 2C:
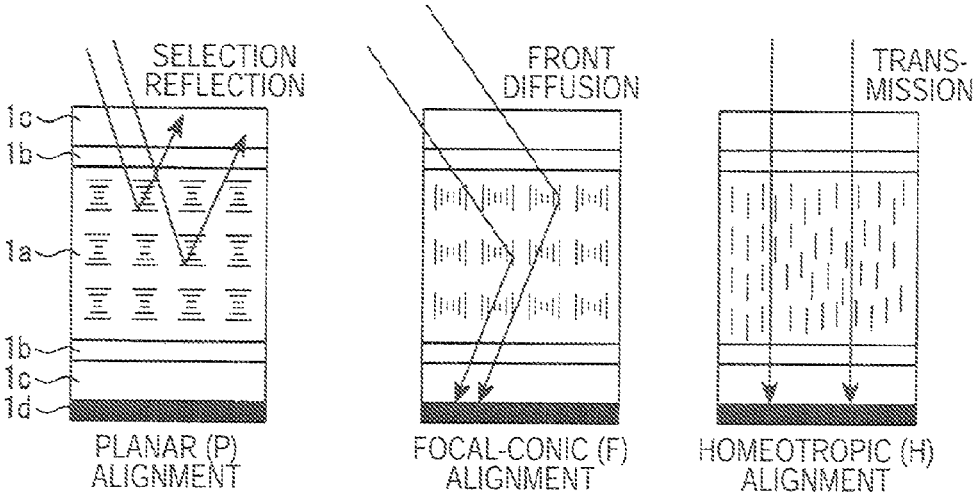
FIGS. 2A to 2C are views explaining an alignment state of a cholesteric liquid crystal.

The display panel 1 has a memory characteristic and a cholesteric liquid crystal is used as display material in the embodiment of the invention. As shown in FIGS. 2A to 2C, a cholesteric liquid crystal layer 1*a* as display material is configured to be placed among transparent electrodes 1*b*, glass substrates 1*c*, light absorbing layer 1*d*, etc. Cholesteric liquid crystal molecules of the cholesteric liquid crystal layer 1*a* have a different light reflectance according to the alignment condition of the molecules. For example, the color of reflective light is displayed in planar alignment of FIG. 2A (hereinafter, referred to as a "P alignment" in brief) since incident light is reflected, and it turns black in focal conic alignment of FIG. 2B (hereinafter, referred to as a "F alignment" in brief) since the incident light is generally transmitted and the transmitted light is absorbed in the light absorbing layer 1*d*. For this reason, by controlling the alignment condition of the cholesteric liquid crystal molecules in each pixel region, it is possible to rewrite the image displayed on the display panel 1, and thereby a display image can he changed. The alignment condition can be controlled by voltage applied to the cholesteric liquid crystal layer 1*a* from the transparent electrode 1*b*. However, since the alignment condition in the P alignment and F alignment is stable, the alignment condition is maintained even when the voltage is not applied. Accordingly, the display image rewritten by applying voltage is maintained without consuming power. Generally, the display panel 1 having the above configuration is equivalent to the display disclosed in claims.

In addition, homeotropic alignment (hereinafter, referred to as a "H alignment" in brief) in FIG. 2C means a condition where the spiral structure of the cholesteric liquid crystal molecules has been collapsed. Although light is transmitted, it is not a stable condition. Therefore, the H alignment is present only in a condition where voltage is applied. The H alignment condition mentioned above is described in DDS driving below.

The temperature data acquiring and storing circuit 3 measures and stores the temperature of the display panel 1 in real time. In the embodiment of the invention, the temperature data acquiring and storing circuit 3 is configured to have a temperature sensor 31, an AD converter 32, a PLD (Programmable Logic Device) 33, and a RAM (random access memory) 34. The temperature sensor 31 is provided adjacent to the display side of the display panel 1 and adjacent to the element member of the display panel 1, for example the light absorbing layer 1*d* (FIGS. 2A to 2C), in the rear side thereof.

Figure 3:
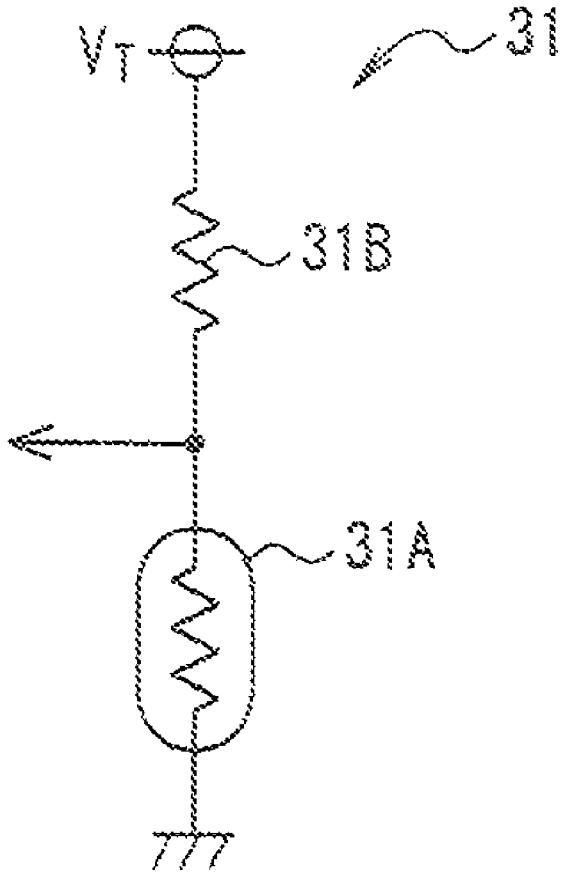
FIG. 3 is a view explaining a temperature sensor.

For example, as shown in FIG. 3, the temperature sensor 31 uses a thermistor 31A as a detecting element of temperature. According to the thermistor 31A, a resistance becomes small when the temperature rises. As show in FIG. 3, an end of the thermistor 31A is connected to the voltage source $V_T$ while the thermistor 31A is connected to a resistance 31B in series. Therefore, in a branch road between the thermistor 31A and the resistance 31B, the voltage value divided by a ratio of the resistance of the thermistor 31A and the resistance 31B is output. The AD converter 32 is connected to the branch road. The AD converter 32 converts the voltage value output as an analogue signal into digital signal, and outputs to the PLD 33. When the temperature data converted into the digital signal by the AD converter 32 is output, the PLD 33 acquires the output temperature data, puts it to the RAM 34, and stores it.

The temperature data acquiring and storing circuit 3 is configured that it is always supplied with voltage through a voltage source system, for example, different from other circuits (the control circuit 4 or the display panel driving circuit 2, and so on), and thereby temperature is measured in succession in a predetermined sampling period (for example, every 10 ms). The temperature data measured in time series are accumulated in a predetermined number of times, and are stored as temperature hysteresis data. In addition, the temperature data acquiring and storing circuit 3 is equivalent to the temperature variation rate detecting unit and the temperature measuring unit disclosed in claims.

The control circuit 4 is configured to have a CPU (central processing unit) 41, a RAM 42, a ROM (read-only memory) 43, and a display panel driving control circuit 44. The control circuit 4 serves as a driving condition setting unit, the driving condition changing unit, and the gradation setting unit in the appended claims.

The CPU 41 starts an operation when a user presses the image rewriting button 5. Then, a control program from ROM 43 is read and the processing based on the control program is initiated. Further, the CPU 41 reads the temperature hysteresis data stored in the RAM 34 of the temperature data acquiring and storing circuit 3, and judges whether a temperature gradient exceeds a threshold value or not. The temperature gradient means a rate of temperature with respect to time variation (in other words, temperature variation rate). For example, a difference between the temperature data measured at 2 points of time preceding the judgment time is used as a temperature gradient.

A correspondence table shows a correspondence relationship between a gradation value which each pixel has as an image data of each pixel (hereinafter, referred to as a "pixel gradation value") and a gradation value for determining an effective voltage value of the driving voltage waveform applied at the time of rewriting each pixel (hereinafter, referred to as a "display gradation value"). Then, depending on the read temperature hysteresis data and the judgment result, the CPU 41 outputs an image rewriting instruction together with the correspondence table (described below) to the display panel driving control circuit 44. At the same time, the image data to be displayed are read from a predetermined area of the ROM 43, developed on the RAM 42, and subjected to image processing in case of need. Thereafter, the data are sent to the display panel driving control circuit 44. In addition, the correspondence table is a table in which the temperature of the display panel 1 is set up as a parameter and in which the relationship is established in order that a display gradation value corresponds to a pixel gradation value. The correspondence table is put in the ROM 43 (FIG. 1).

The display panel driving control circuit 44 converts the pixel gradation value of each pixel into the display gradation value based on the correspondence table when the image rewriting instruction is output from the CPU 41. Specifically, in the embodiment of the invention, the number of gradation value for image displayed on the display panel 1 is 4, and the image data (pixel gradation value) of each pixel is represented by 4 kinds=2 bits. Therefore, the image data output to the display panel driving control circuit 44 from the CPU 41 is data represented by 2 bits.

In addition, in the embodiment of the invention, the pixel gradation value may be a value that represents a reflectance divided into 4 equal parts, when the reflectance is represented as a standardized value (called as a standardized reflectance) where 1 represents a condition that the reflectance in the display side of the display panel 1 is the highest (white state) and 0 represents a condition that the reflectance is the lowest (black state). In other words, a value equivalent to the standardized reflectance (0, ⅓, ⅔, 1) equivalent to a gradation expression of 4 steps is provided. Originally, since the pixel gradation value equivalent to the 4 gradations is a value equivalent to a reflectance or transmission ratio of the pixel forming the image with respect to the image displayed on the display panel in practice, the pixel gradation value is determined depending on a display material used in the display panel.

In the meantime, the effective voltage value of driving voltage waveform (hereinafter, it maybe referred to as a "selection voltage") applied in a selection period when the final molecule alignment of the cholesteric liquid crystal is selected and determined between the P alignment and F alignment mentioned above (this period is referred to as a "selection period" in DDS driving system described below) is provided with 16 kinds of effective voltage values (V0 to V15) represented by 4-bit data in the embodiment of the invention as described below. Therefore, since the converted display gradation value is data specifying 4 kinds of effective voltage values corresponding to the pixel gray value among the 16 kinds of effective voltage values, 16 kinds same as the effective voltage value are present in the embodiment of the invention.

The display panel driving circuit 2 acquires 4-bit data representing 4 kinds of effective voltage values output from the display panel driving control circuit 44, generates a predetermined driving voltage waveform, and apply the voltage to each pixel of the display panel 1 where transversal and longitudinal electrodes that are not shown in figures are crossed. Specifically, in the embodiment of the invention, the display panel driving circuit 2 is configured to have electrodes (FIGS. 2A to 2C, transparent electrodes 1*b*) in a simple matrix where a plurality of scan lines (transversal electrodes) and a plurality of data lines (longitudinal electrodes) are formed in a matrix, scan drivers driving the plurality of scan lines, and data drivers driving the plurality of data lines.

The data drivers are provided with a PWM circuit that can make a PWM (Pulse Width Modulation). Further, based on the 4-bit data, the data drivers modulate and modify the pulse width of the voltage pulse that is the driving voltage waveform applied to the pixel to be driven. Therefore, the pulse width representing a time at which a predetermined voltage is output is controlled by the PWM circuit, and thereby 16 kinds of effective voltage values (V0 to V15) are output from the display panel driving circuit 2. Therefore, the driving voltage waveform that has a pulse width corresponding to 4 selected effective voltage values is applied to pixels to be driven.

(B) DDS Driving System of the Cholesteric Liquid Crystal

In the meantime, DDS driving system is used in the embodiment of the invention as a driving method of the display panel 1. A predetermined driving voltage waveform (for example, a driving voltage waveform disclosed in the above-mentioned U.S. Pat. No. 5,748,277) is applied to the cholesteric liquid crystal layer 1*a*, which is positioned in each pixel of the display panel 1, during the selection period, thereby rewriting the image data.

Here, DDS driving system is described. DDS driving system is a method determining the final alignment condition of liquid crystal along processes shown in FIG. 4A. In other words, first, in the preparation period, voltage is applied such that liquid crystal having P alignment or F alignment is changed to H alignment shown in FIG. 2C. Next, in the selection period, a voltage to select a final image display condition (whether F alignment is made or P alignment is made, after rewriting) is applied. In this case, by applying the effective voltage value depending on the display gradation value, whether maintaining H alignment or whether transferring into a condition that a twist of spiral structure, called as a transitional planar alignment (TP alignment), is slightly loosened is selected. Then, in a pixel, a mixing ratio between H alignment and TP alignment depending on the applied effective voltage values is controlled at a level of liquid molecule unit, thereby realizing a gradation expression including medium gradation by area gradation. In the evolution period, a voltage to settle down the final image display condition selected in the selection period is applied.

Accordingly, although H alignment in the selection period is maintained as it is, H alignment is ultimately changed into P alignment when the voltage is eliminated. In the meantime, the liquid crystal molecules of TP alignment are changed into F alignment in the evolution period, and ultimately settled down to the F alignment. That is, by applying the effective voltage value to the pixel in the selection period, it is possible to rewrite images to be displayed on the display panel 1. In addition, when all liquid crystal molecules of a pixel are in P alignment, then white color is represented. In addition, when all liquid crystal molecules of a pixel are in F alignment, then black color is represented. In addition, when P alignment and F alignment are mixed, then gray color is represented depending on mixing ratio.

As described above, since DDS driving system can determine the display gradation of pixel in the selection period, the images displayed on the display panel 1 can be rewritten in a short time. In addition, since the length of selection period is set in accordance with the temperature of the display panel 1 in rewriting images, the selection period is not changed while the images are being rewritten. Furthermore, the selection period is set up long when the temperature of the display panel 1 is low. The selection period is equivalent to the selection period described in claims.

(C) First Example of Temperature Compensating Process in the Embodiment of the Invention In the meantime, in the image display device 100 according to the embodiment of the invention, an error occurs in driving between the estimation temperature of the display panel 1 and the real temperature of the cholesteric liquid crystal when the temperature of the display panel 1 is varied. In particular, the error becomes remarkable when the image display device 100 is moved from the cold outdoors to the warm indoors. Thus, when the display panel 1 is rewritten and driven depending on the effective voltage value set up pursuant to the estimation temperature, an effective voltage value different from the effective voltage value that should be applied to the pixel in the selection period are applied, and thereby image cannot be correctly displayed.

In the first place, the first example of temperature compensating process that the image display device makes is to change and to treat an effective voltage value to be applied depending on the temperature variation rate of the display panel 1. This process is described using the flow chart shown in FIG. 5.

Figure 6:
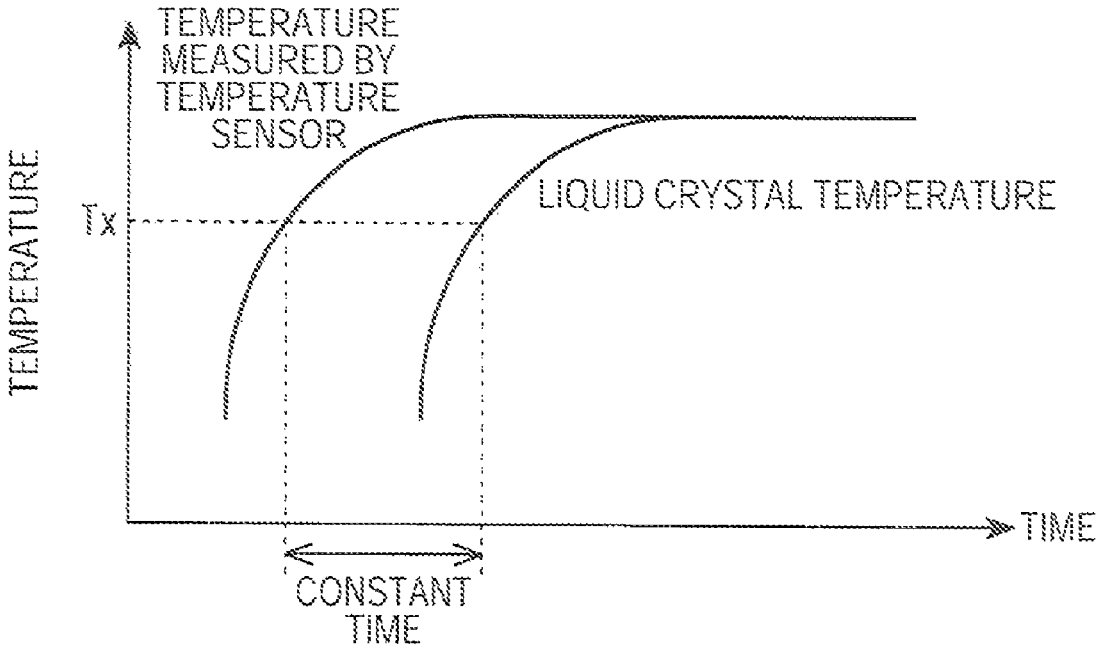
FIG. 6 is a graph explaining time variation in the temperature of the cholesteric liquid crystal.

The CPU 41 is started when the image rewriting button 5 is pressed. When this process is initiated, first, the CPU 41 acquires the temperature data that the temperature data acquiring and storing circuit 3 has acquired until that time, and the process where the temperature of the display panel 1 is estimated is carried out (step S101). In the embodiment of the invention, as the estimation temperature of the display panel 1, the CPU 41 uses a temperature acquired from the hysteresis temperature of the temperature data. That is, since the temperature sensor 31 is attached on a rear side of the display panel 1, the response to the change of environmental temperature comes over faster than that of the liquid crystal material inside the panel. Therefore, it is suggested that the measured temperature of the temperature sensor and the temperature of the liquid crystal material are varied with respect to time as shown in FIG. 6. There, for example as shown in FIG. 6, the past measured temperature Tx that the temperature sensor measured going back to "a prescribed time" from the driving of the display panel 1 is used as a designated temperature with respect to the hysteresis temperature of temperature data. The "prescribed time" may be obtained by experiment or experience, or may be computed by thermal conductivity of the glass substrate 1*c*, etc., or heat capacity.

In next step S102, the process where the correspondence table where the estimation temperature is a parameter data is selected is carried out. In step S102, the estimation temperature in driving the display panel 1 is acquired from the obtained temperature data as described above, and the selection period to realize DDS driving system is set up according to the estimation temperature.

Figure 5:
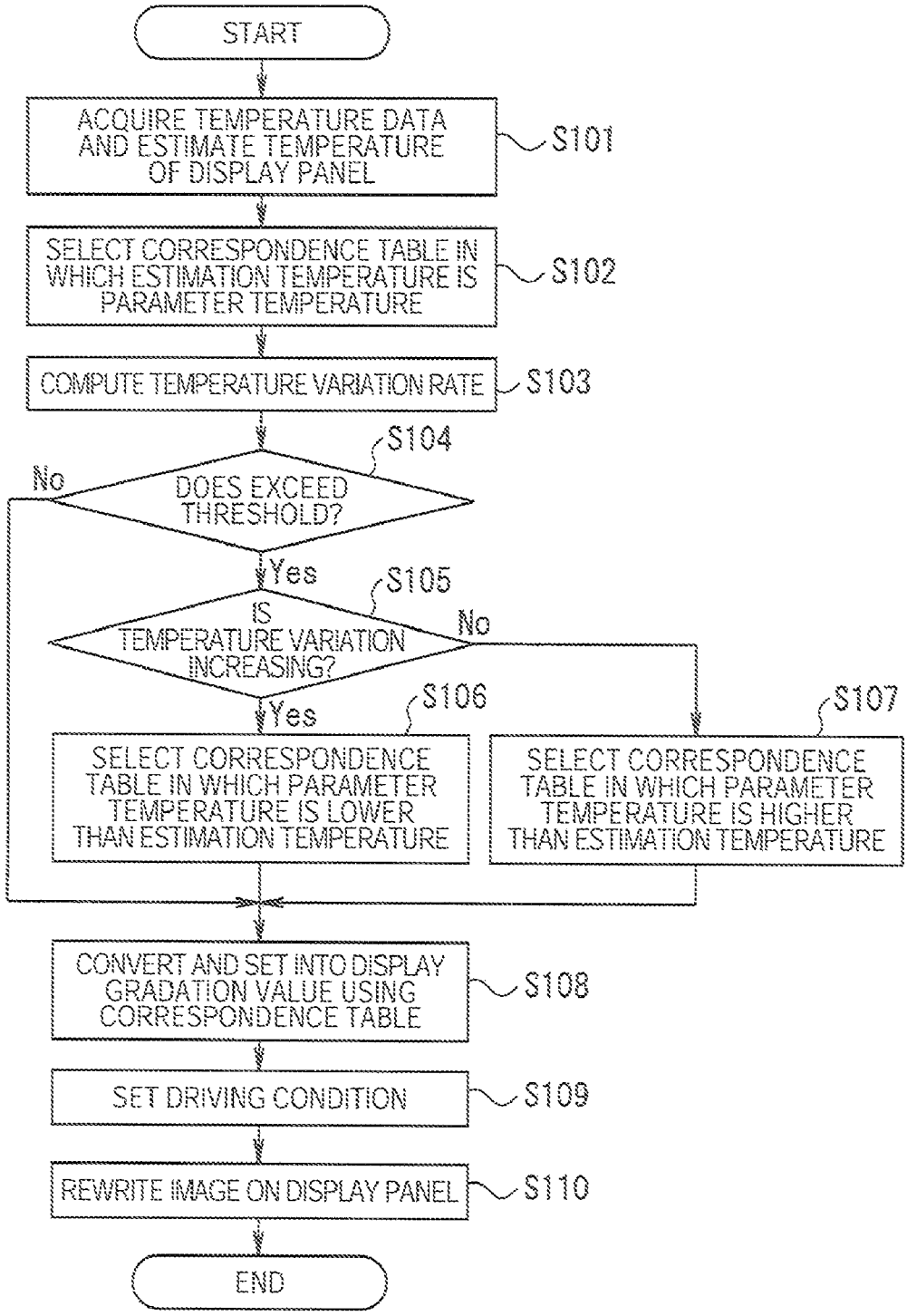
FIG. 5 is a flowchart explaining an operation of the first example of the image display device.

Next, going back to FIG. 5, in step S103, the process where the temperature variation rate is computed is carried out. As the temperature variation rate, the CPU 41 computes a temperature gradient as described above, where a difference of the measured temperatures on 2 points of time among the hysteresis temperatures is divided by the elapsed time between 2 points of time.

Thereafter, in next step S104, it is determined whether the absolute value of the time gradient exceed a set threshold value or not. When the absolute value is the threshold value or less (NO), then the process goes to step S108. When the absolute value of the temperature gradient is the threshold value or less, it maybe suggested that the real temperature of the liquid crystal material approximately follows the hysteresis temperature measured by the temperature sensor 31. Therefore, the process goes to step S108 without selecting the correspondence table described below.

In the meantime, when the absolute value of the temperature gradient exceeds the threshold value (YES), then it is determined in the next step S105 whether temperature variation is a rise state or not. In step S105, since the temperature variation is a rise when the temperature gradient is positive (YES), the process goes to step S106. In addition, the process where correspondence table where a parameter temperature is lower than the estimation temperature acquired in step S101 is selected is carried out. In the meantime, since the temperature variation is a fail state when the temperature gradient is minus (NO), the process goes to step S107. In addition, the process where correspondence table where a parameter temperature is higher than the estimation temperature acquired in step S101 is selected is carried out.

Figure 7:
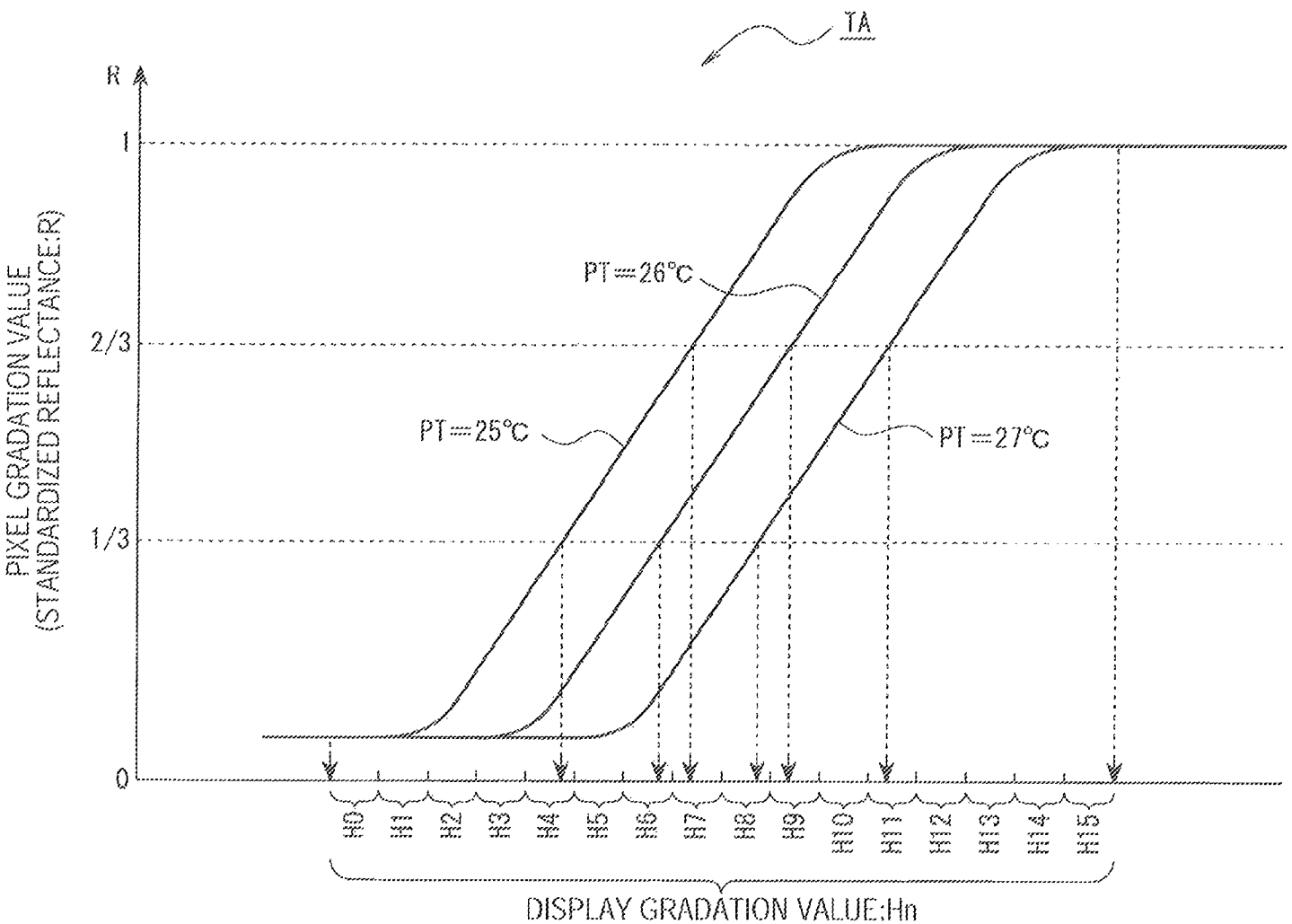
FIG. 7 is a view showing a correspondence table that prescribes a correspondence relationship between a pixel gradation value and a display gradation value.

Here, an example of the correspondence table TA according to the embodiment of the invention is shown in FIG. 7. In the correspondence table TA, the correspondence relationship between pixel gradation value and display gradation value with respect to a selection period set based on the estimation temperature in step S102 when the temperature PT of the display panel 1 is a parameter is prescribed. For example, it is shown in FIG. 7 that the real temperature PT of the display panel 1 is 25° C., 26° C., and 27° C. when the estimation temperature is 27° C. The axis of ordinates represents the standardized reflectance R as the pixel gradation value, and the axis of abscissa represents the 16 kinds of display gradation values Hn (n=0-15) that are values to determine the effective voltage value applied to the pixel so as to get the standardized reflectance.

Furthermore, the values of the display gradation values Hn are provided such that effective voltage value gradually increases as n becomes large. Therefore, the correspondence table TA represents so called a VR characteristic curve that represents a characteristics of the brightness of the display panel and the voltage when temperature PT is a parameter.

In steps S106 and S107, the temperature PT which is a base in the below process is selected in the correspondence table TA and the deviation of the gradation display resulted from the deviation between the estimation temperature and the real temperature of the liquid crystal is corrected.

For example, since the temperature is rapidly rising when the temperature gradient is positive, the real temperature of the liquid crystal material follows from the temperature that is lower than the hysteresis temperature (that is, estimation temperature) measured by the temperature sensor 31. Therefore, when the estimation temperature acquired in step S102 is 26° C., a correspondence table in which a temperature lower than 26° C. (for example, 25° C.) is a parameter temperature PT is selected (step S106). In addition, when the real temperature of the liquid crystal is lower than the estimation temperature, a selection period is set to be shorter than a period that should be set with respect to the real temperature of the liquid crystal. For this reason, TP alignment cannot be selected in the selection period, and thereby the color of display becomes white as a whole (it turns into P alignment).

On the contrary, since the temperature is rapidly falling when the temperature gradient is minus, the real temperature of the liquid crystal material follows from the temperature that is higher than the hysteresis temperature (that is, estimation temperature) measured by the temperature sensor 31. Therefore, when the estimation temperature acquired in step S102 is 26° C., a correspondence table in which a temperature TP higher than 26° C. (for example, 27° C.) is a parameter temperature is selected (step S107). Furthermore, when the real temperature of the liquid crystal is higher than the estimation temperature, a selection period is set to be longer than a period that should be set with respect to the real temperature of the liquid crystal. For this reason, the alignments are changed into TP alignment in the selection period, and thereby the color of display becomes black as a whole (it turns into F alignment).

As to the estimation temperature, whether the estimation temperature is set to be high or low to what extent depends on the configuration of the display panel 1 or the display material. However, it is preferable that actual measurement is performed by providing a predetermined temperature variation rate beforehand and that an estimation temperature is set up beforehand based on the actual measurement results.

Then, in step S108, the pixel gradation values are changed and processed into the display gradation values using the selected correspondence table. As shown in FIG. 7, a pixel gradation value (standardized reflectance) is changed and set up to a display gradation value in the example of the invention. For example, in case that a correspondence table where temperature TP is equal to 27° C. is selected, 4 kinds of (H0, H8, H11, H15) are selected as the display gradation values. As such, the display panel driving control circuit 44 outputs 4-bit data to the display panel driving circuit 2 as data of selection voltage applied to the target pixel in the selection period. Here, 4-bit data represents the kind of each display gradation value in (H0, H8, H11, H15). In addition, in case that a correspondence table where temperature TP is equal to 25° C. is selected, 4 kinds of (H0, H4, H7, H15) are set up as the display gradation value.

Next, in step S109, the process where the driving condition corresponding to the set display gradation value is set is carried out. In step S109, selection voltage is determined according to the display gradation value, effective voltage values are specified in accordance with the determined selection voltage, and driving voltage waveforms having the effective voltage values are generated. Thereafter, the generated driving voltage waveforms are applied to the target pixel, the image of the display panel 1 is rewritten (step S110), and the process of the first example is finished.

Accordingly, when the temperature variation rate of the display panel 1 is large, the real temperature of display material, or liquid crystal material is different from the estimation temperature in the correspondence table that is selected according to the estimation temperature. Therefore, the image becomes bright or dark. However, according to the example of the invention, the correspondence table to be selected is changed when the temperature variation rate (the absolute value of temperature gradient) exceeds the threshold value. For this reason, in the example of the invention, it is prevented that the image becomes bright or dark, and it is possible that correct and natural gradation is reproduced.

Figure 4B:
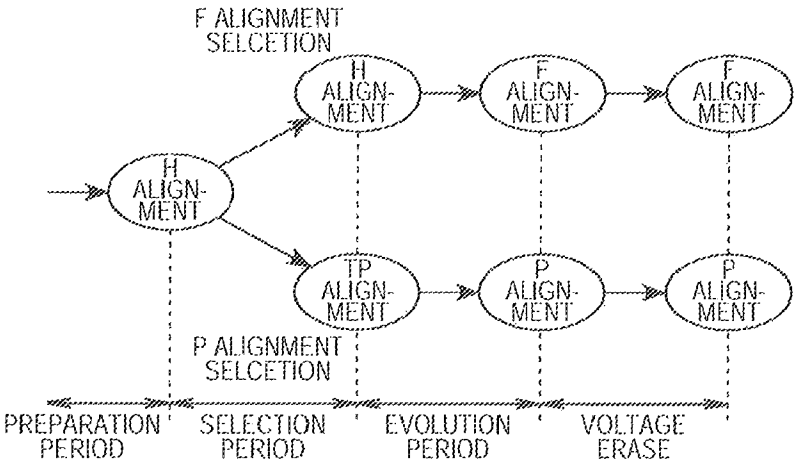
FIGS. 4A and 4B are views showing a transition of an alignment state of a cholesteric liquid crystal.
Figure 4A:
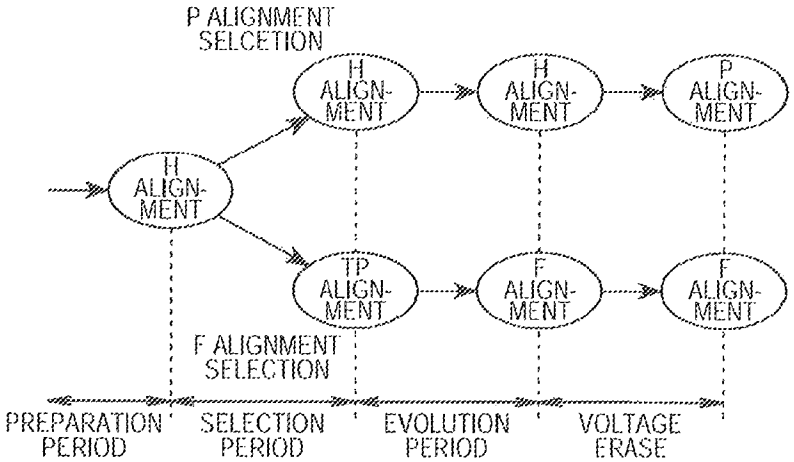

In addition, DDS driving system is not limited to the method shown in FIG. 4A. DDS driving system includes that alignment condition is selected along the process shown in FIG. 4B. In this case, the process in FIG. 4B is same as FIG. 4A until the selection period. However, applying voltage in FIG. 4B is lower than that in FIG. 4A in the evolution period. Therefore, the alignment condition is changed in the evolution period differently compared to FIG. 4A. That is, H alignment that was maintained during the selection period is changed into F alignment. In addition, the alignment that was changed into TP alignment is changed into P alignment, and the P alignment becomes the final alignment condition.

Therefore, this case is very reverse to what is described above. That is, when the temperature gradient is positive, it is not possible that the alignment condition is changed into TP alignment in the selection period. Thus, the color of display becomes black as a whole (it turns into F alignment). Accordingly, through selecting the correspondence table in which a temperature higher than the estimation temperature, display images become bright as a whole. This results in offsetting, and thereby it is possible that correct and natural gradation is reproduced. In other words, when the temperature gradient is minus, the alignment condition is inclined to change into TP alignment in the selection period. Thus, the color of display becomes white as a whole (it turns into P alignment). Accordingly, through increasing gamma value, display image becomes dark as a whole. This results in offsetting, and thereby it is possible that correct and natural gradation is reproduced.

(D) Second Example of Temperature Compensating Process in this Embodiment

The first example described above sets so as to change the pixel gradation value into the display gradation value by the correspondence table of which the parameter is the temperature and relates to the process method that corrects the temperature difference between the estimation temperature generating due to the temperature variation in the display panel and the real temperature of the liquid crystal. Next, the second example according to this embodiment uses a gamma value described below and conducts the correction process by setting so as to change the pixel gradation value into the display gradation value. This process will be described with reference to the flowchart of FIG. 8.

The CPU 41 is started up by pushing the image rewriting button 5, and this process is started. Furthermore, in a process flowchart of the second example shown in FIG. 8, the same reference numerals can be denoted to the same step as the step in the process flowchart of the first example shown in FIG. 5. That is, since the process steps (for example, S101, S103 or the like) other than steps S102*a*, S106*a*, S107*a*, and S108*a* are equal to those in FIG. 5, the description of those same process steps will be omitted herein. Accordingly, the process content will be described with respect to the different process steps.

The CPU 41 is started up by pushing the image rewriting button 5, and when this process is started. When this process is initiated, first, the CPU 41 acquires the temperature data that the temperature data acquiring and storing circuit 3 has acquired until that time, and the process where the temperature of the display panel 1 is estimated is carried out (step S101). Then, a process that sets a gamma value from the estimation temperature is performed in following step 102*a*.

The gamma value will be described herein. The gamma value is to prescribe such that the pixel gradation value X and the display gradation value Y satisfy the correspondence relationship of the following Equation 1. This gamma value is a parameter required for the generation of the driving voltage waveform and is a parameter for determining an effective voltage value applied to the pixel at the selection period in this embodiment. More specifically, when the temperature is high, since viscosity of the liquid crystal molecular is low, the gamma value is set such that the effective voltage value applied at the selection period is small. Moreover, when the temperature is low, since the viscosity of the liquid crystal molecular is high, the gamma value is set such that the effective voltage value applying at the selection period is large.

$$Y=X^{\gamma}$$

In addition, according to this example, each value of the pixel gradation value and the display gradation value the pixel gradation value is represented as a standardized value (referred to as "a standardized reflectance"), where 1 represents a condition that the reflectance in the display side of the display panel 1 is the highest (white state) and 0 represents a condition that the reflectance is the lowest (black state). Naturally, when the image data is any gradation value of 0 to 255 displayed by 8 bit for each pixel, the gradation value "0" is assumed to the standardized reflectance "0", and the gradation value "255" is assumed to the standardized reflectance "1". For example, by a gradation converting process using a dither matrix, the value that converts the gradation value of each pixel into the standardized reflectance may be assumed to the pixel gradation value. This is one example of "image processing in case of need" that is performed by the CPU 41 described above. Accordingly, "pixel gradation value" means the value that corresponds to the reflectance or the transmittance of the pixel forming the image actually displayed on the display panel. Undoubtedly, the "pixel gradation value" is decided with the display material used for the display. Moreover, it is assumed that the pixel gradation value has the value of the standardized reflectance (0, ⅓, ⅔, 1) corresponding to the gradation display of the four stages even in this example.

In addition, when the gamma value is set to 1 in the Equation 1, since each pixel gradation value X of four gradation is (0, ⅓, ⅔, 1), the display gradation value Y is (0, ⅓, ⅔, 1). Then, the selection voltage corresponding to the display gradation value (0, ⅓, ⅔, 1) is selected.

Figure 9:
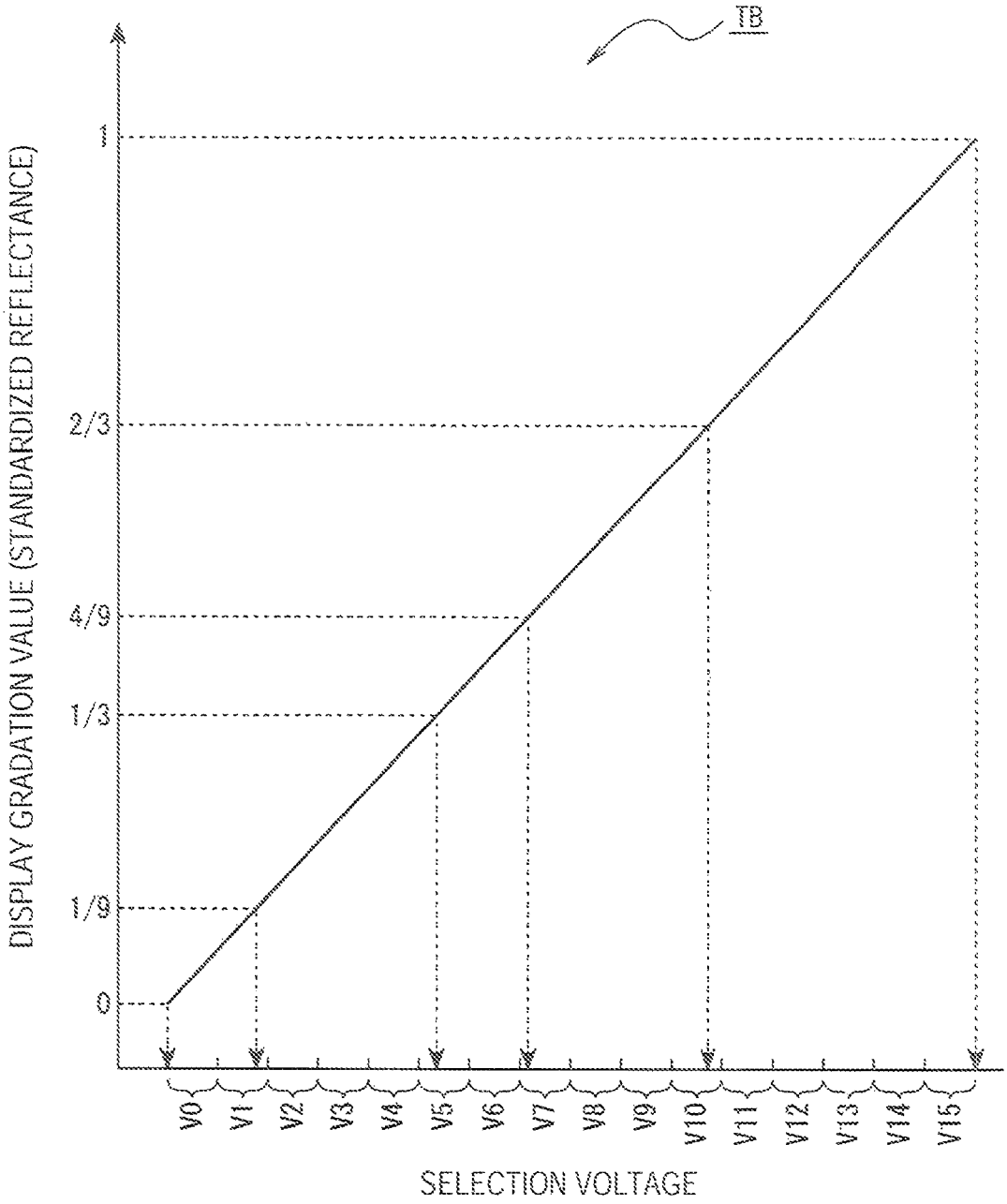
FIG. 9 is a graph showing the relationship between a selection voltage and a display gradation value.

In this example, the selection voltage corresponding to the display gradation value is stored in the ROM 43 (see FIG. 1) as a predetermined table TB such that one display gradation value (standardized reflectance) is correlated to the one effective voltage, as shown in FIG. 9. Therefore, when the gamma value is 1, four kinds of selection voltages (V0, V5, V10, V15) are selected from the table TB. As described above, the display panel driving control circuit 44 outputs 4-bit data that shows the kind of each effective voltage value of (V0, V5, V10, V15) to the display panel driving circuit 2 as a data of the selection voltage applied into a target pixel at the selection period in accordance with the pixel gradation values (0, ⅓, ⅔, 1) of four gradations outputted from the CPU 41.

In addition, when the gamma value is set to "2" larger than "1", the display gradation value Y corresponding to the pixel gradation value X (0, ⅓, ⅔, 1) of four gradations becomes (0, 1/9, 4/9, 1). Therefore, the four kinds (V0, V1, V7, V15) of the selection voltages are selected in accordance with the display gradation values (0, 1/9, 4/9, 1) of four gradations from FIG. 9. Then, the display panel driving control circuit 44 outputs 4-bit data that shows the kind of each effective voltage value of (V0, V1, V7, V15) to the display panel driving circuit 2.

As can be blown from the description of the above gamma value, when it makes increase the gamma value, since the display gradation value showing the middle standardized reflectance moves to a black side (0), the display image darkens. Meanwhile, when it makes reduce the gamma value, since the display gradation value showing the middle standardized reflectance moves to a white side (1), the display image brightens.

Next, in step S103, the process where the temperature variation rate is computed is carried out. As the temperature variation rate, the CPU 41 computes a temperature gradient as described above, where a difference of the measured temperatures on 2 points of time among the hysteresis temperatures is divided by the elapsed time between 2 points of time.

Thereafter, in next step S104, it is determined whether the absolute value of the time gradient exceed a set threshold value or not. When the absolute value is the threshold value or less (NO), then the process goes to step S108. Meanwhile, when the absolute value exceeds the threshold value (YES), then it is determined in the next step S105 whether temperature variation is a rise state or not.

In step S105, since the temperature variation is a rise when the temperature gradient is positive (YES), the process goes to step S106*a*. In addition, the process that changes the gamma value to a high value which was set in step S102 is carried out. In the meantime, since the temperature variation is a fail state when the temperature gradient is minus (NO), the process goes to step S107*a*. In addition, the process that changes the gamma value to a low value which was set in step S102 is carried out.

For example, when the gamma value set in step S102 is "2", since the environmental temperature is rapidly rising when the temperature gradient is positive, the real temperature of the liquid crystal material follows from the temperature that is lower than the hysteresis temperature (that is, estimation temperature) measured by the temperature sensor 31. Therefore, since the real temperature of the liquid crystal is lower than the estimation temperature, the effective voltage value applied to the selection period becomes smaller than an ideal value. For this reason, TP alignment cannot be selected in the selection period, and thereby the color of display becomes white as a whole (it turns into P alignment). Therefore, by increasing the gamma value to "2.5", display image becomes dark as a whole. This results in offsetting, and thereby it is possible that correct and natural gradation is reproduced (step S106*a*).

On the contrary, since the environmental temperature is rapidly failing when the temperature gradient is negative, the real temperature of the liquid crystal material follows from the temperature that is higher than the hysteresis temperature (that is, estimation temperature) measured by the temperature sensor 31. Therefore, since the real temperature of the liquid crystal is higher than the estimation temperature, the effective voltage value applied to the selection period becomes larger than an ideal value. For this reason, TP alignment is selected in the selection period, and thereby the color of display becomes black as a whole (it turns into F alignment). Therefore, by decreasing the gamma value to "1.5", display image becomes bright as a whole. This results in offsetting, and thereby it is possible that correct and natural gradation is reproduced (step S107*a*).

In addition, when the absolute value of the temperature gradient is not more than the threshold value, since it may be considered that the real temperature of the liquid crystal material follows virtually the hysteresis temperature measured by the temperature sensor 31, the process proceeds to step S108*a* without changing the gamma value.

Next, after converting into the display gradation value by using the gamma value set or changed in step S108*a*, in step S109, the process where the driving condition corresponding to the display gradation value is set is carried out. In step S109, selection voltage is determined according to the display gradation value, effective voltage values are specified in accordance with the determined selection voltage, and driving voltage waveforms having the effective voltage values are generated. Thereafter, the generated driving voltage waveforms are applied to the target pixel, the image of the display panel 1 is rewritten (step S110), and the process of the second example is finished.

Accordingly, when the temperature variation rate of the display panel 1 is large, the real temperature of display material, or liquid crystal material is different from the estimation temperature in the optimum gamma value that is set according to the estimation temperature. Therefore, the image becomes bright or dark. However, according to the example of the invention, the gamma value is changed when the temperature variation rate (the absolute value of temperature gradient) exceeds the threshold value. For this reason, in the example of the invention, it is prevented that the image becomes bright or dark, and it is possible that correct and natural gradation is reproduced.

In addition, DDS driving system is not limited to the method shown in FIG. 4A. DDS driving system includes that alignment condition is selected along the process shown in FIG. 48. In this case, like the first example, the process in FIG. 4B is same as FIG. 4A until the selection period. However, applying voltage in FIG. 4B is lower than that in FIG. 4A in the evolution period. Therefore, the alignment condition is changed in the evolution period as differently compared to FIG. 4A. That is, H alignment that was maintained during the selection period is changed into F alignment. In addition, the alignment that was changed into TP alignment is changed into P alignment, and the P alignment becomes the final alignment condition.

Therefore, this case is very reverse to what is described above. That is, when the temperature gradient is positive, it is not possible that the alignment condition is changed into TP alignment in the selection period. Thus, the color of display becomes black as a whole (it turns into F alignment). Accordingly, by reducing the gamma value, display images become bright as a whole. This results in offsetting, and thereby it is possible that correct and natural gradation is reproduced. In other words, when the temperature gradient is minus, the alignment condition is inclined to change into TP alignment in the selection period. Thus, the color of display becomes white as a whole (it turns into P alignment). Accordingly, through increasing gamma value, display image becomes dark as a whole. This results in offsetting, and thereby it is possible that correct and natural gradation is reproduced.

(E) Third Example of Temperature Compensating Process in this Embodiment

Although the above first example and the second example describe the case where the gradation display of four gradations including a halftone is corrected in accordance with the temperature variation rate, when the temperature variation rate actually occurring exceeds the threshold value, there exist the case where it is difficult to conduct display of the image of the original number of gradation. For example, in case where the estimation temperature is considerably high itself and the temperature thereof rises, or the estimation temperature is considerably low itself and the temperature thereof lowers, reversely, the effective voltage value for displaying the halftone is not set from sixteen kinds controlled by PWM circuit. Alternatively, when the temperature variation drops suddenly from rising and rises suddenly from lowering, it is difficult to estimate variation behavior in the temperature of the real liquid crystal. For example, in case of changing the set of the gamma value based on the estimation temperature in the second example, the display gradation can not be exactly corrected.

Figure 10:
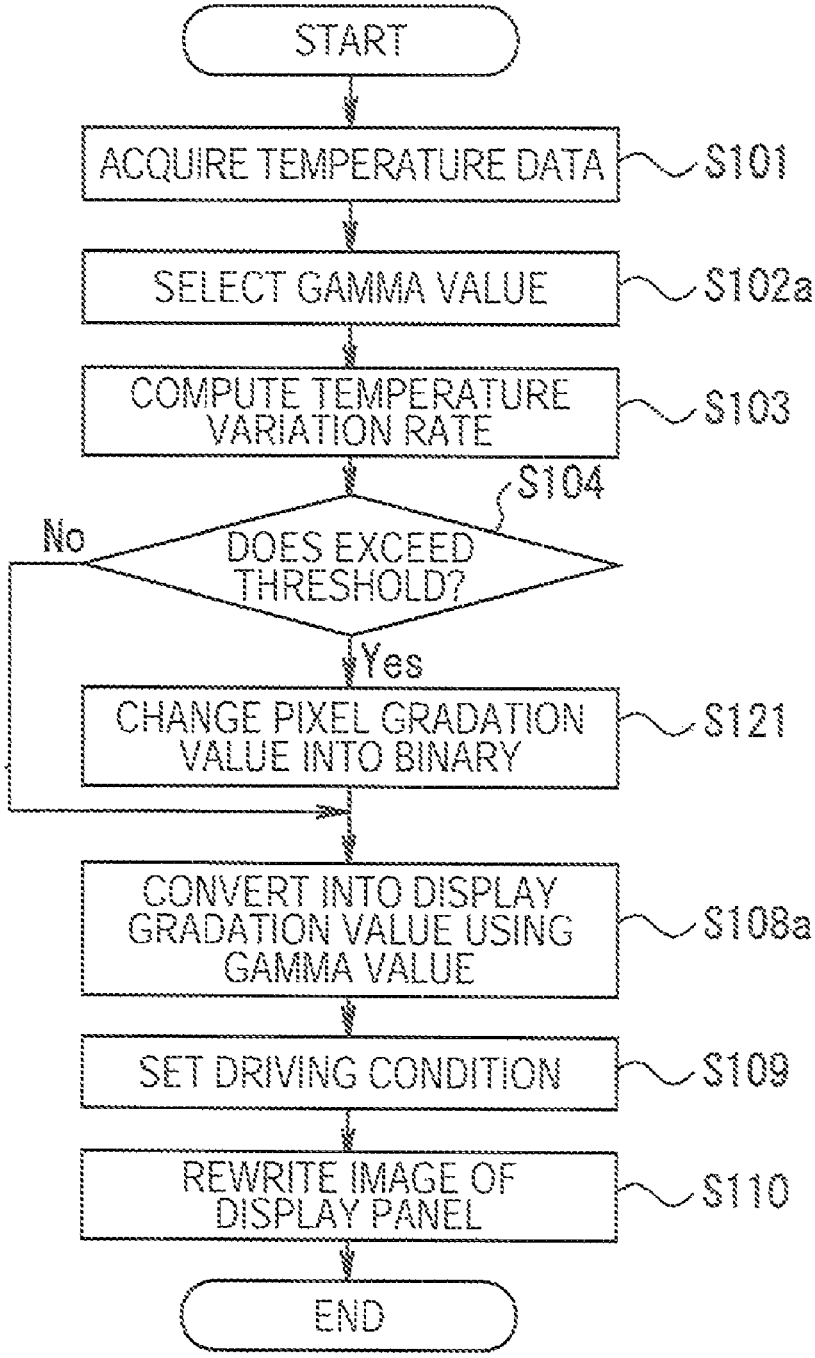
FIG. 10 is a flowchart explaining an operation of a third example of the image display device.

Consequently, a third example of the temperature compensating process conducted by the image display device of this embodiment is to reduce the number of the gradation display in accordance with the temperature variation rate of the display panel 1. For this reason, for example, since the halftone (for example, gray) is changed into the black or white in advance, one character is prevented from becoming thick or thin. Therefore, it is possible to display the stable image without being affected by the temperature variation. This process will be described with reference to the flowchart of FIG. 10.

The CPU 41 is started up by pushing the image rewriting button 5, and this process is started. Furthermore, in a process flowchart of the third example shown in FIG. 10, the same reference numerals can be denoted to the same step as the step in the process flowchart of the second example shown in FIG. 8. That is, since the process steps S101 to S104 and process steps S108 to S110 are equal to those in FIG. 8, the description of those same process steps will be omitted herein. Accordingly, the process content of step S121 will be described.

In the third example, when the absolute value of the temperature gradient exceeds the threshold value in step S104 (YES), the pixel gradation value is changed into a binary in step S121. In the second example, the number of gradation of the image displayed on the display panel 1 is four gradation, and the display gradation value into which the pixel gradation value (0, ⅓, ⅔, and 1) of each pixel is converted by the display panel driving control circuit 44 is converted into four kinds of the gradation values in accordance with the set gamma value when an image rewriting instruction designating the gamma value from the CPU 41 is output. Moreover, four kinds of the selection voltages corresponding to the converted display gradation value are selected.

In the third example, when the display panel driving control circuit 44 converts the pixel gradation value into the display gradation value on the basis of the gamma value, the pixel gradation values (0, ⅓, ⅔, and 1) of four gradations are changed into two kinds of pixel gradation values (0, 1) in advance. In this example, the pixel gradation value (⅓) is changed into the pixel gradation value (0), and the pixel gradation value (⅔) is changed into the pixel gradation value (1). More specifically, as described above, when the image is any gradation value of 0 to 255 displayed by 8 bit for each pixel, the gradation value is binarized into "0" and "255" by the gradation converting process using the dither matrix for binarization, and the binarized gradation value is converted into the pixel gradation value having the standardized reflectance "0" and the standardized reflectance "1".

As can be known from the above description, the pixel gradation values (0) and (1) are converted into the display gradation values (0) and (1) irrespective of the gamma value, respectively. As a result, as shown in FIG. 9, the selection voltage selects the minimum and maximum effective voltage values based on the display gradation value. Moreover, since the stable alignment state of the liquid crystal can be selected for each pixel, it is possible to stably display the white or black. Accordingly, one character is prevented from becoming thick or thin due to the black display of the pixel gradation value (⅓) and the white display of the pixel gradation value (2/3), and it is possible to display the stable image without depending on the temperature variation rate of the display panel 1.

As described above, according to the third example, when the temperature variation rate of the display panel 1 is large, for example, the halftone gradation value showing the gray is converted into the binary gradation value showing the white or black in advance such that the character becomes not thick or thin. As a result, even when the temperature variation rate (absolute value of the temperature gradient) exceeds the threshold value, it is possible to display natural image without forming thickly or thinly the character line.

Although the first embodiment and the examples of the invention were described, the invention is not limited to those embodiment and examples, various modifications may be made without departing from the spirit or scope of the invention. Modified examples will be described hereinafter.

FIRST MODIFIED EXAMPLE

In the above embodiment, the pixel gradation value is replaced with the standardized reflectance without changing the image data stored in a predetermined area of the ROM 43, and the pixel gradation value is converted into the display gradation value in accordance with the set gamma value. Moreover, the selection voltage corresponding to the converted display gradation value is selected. For this reason, when the set gamma value is varied, the converted display gradation value is also varied. Accordingly, the kind of the selection voltage corresponding to the converted display gradation value increases, and sixteen kinds of the 4-bit selection voltage are provided in the above embodiment.

Therefore, in order to apply the effective voltage corresponding to the sixteen kinds of the selection voltage to the driving target pixel, it generates sixteen kinds of the driving voltage waveforms that change a pulse width of an output voltage pulse by the PWM circuit. However, generally, as the kind of the driving voltage waveform applied to the display panel 1 becomes small, the deriving is easy. In addition, even though not described, when the kind of driving voltage waveform is small, it is possible to restrain a main cause, such as a crosstalk that deteriorates the display image quality. Here, the first modified example may be configured such that only the driving voltage waveform of the predetermined poise width is applied by reducing the selection voltage, that is, the kind number of driving voltage waveforms.

In this manner, for example, since the driving voltage waveform different from the driving voltage waveform for an original display gradation is applied, the gradation different from the gradation for the original display is displayed. Here, in this modified example, the image data different from the image data stored in the predetermined area of the ROM 43 is generated. At this time, the display gradation value prescribed in accordance with the set gamma value is constantly similar to the pixel gradation value of which the generated image data is converted into the standardized reflectance. For this reason, the selection voltage to be selected is constantly identical, and only the driving voltage waveform of the predetermined pulse width may be applied to the pixel during the rewriting process of the image.

Figure 11:
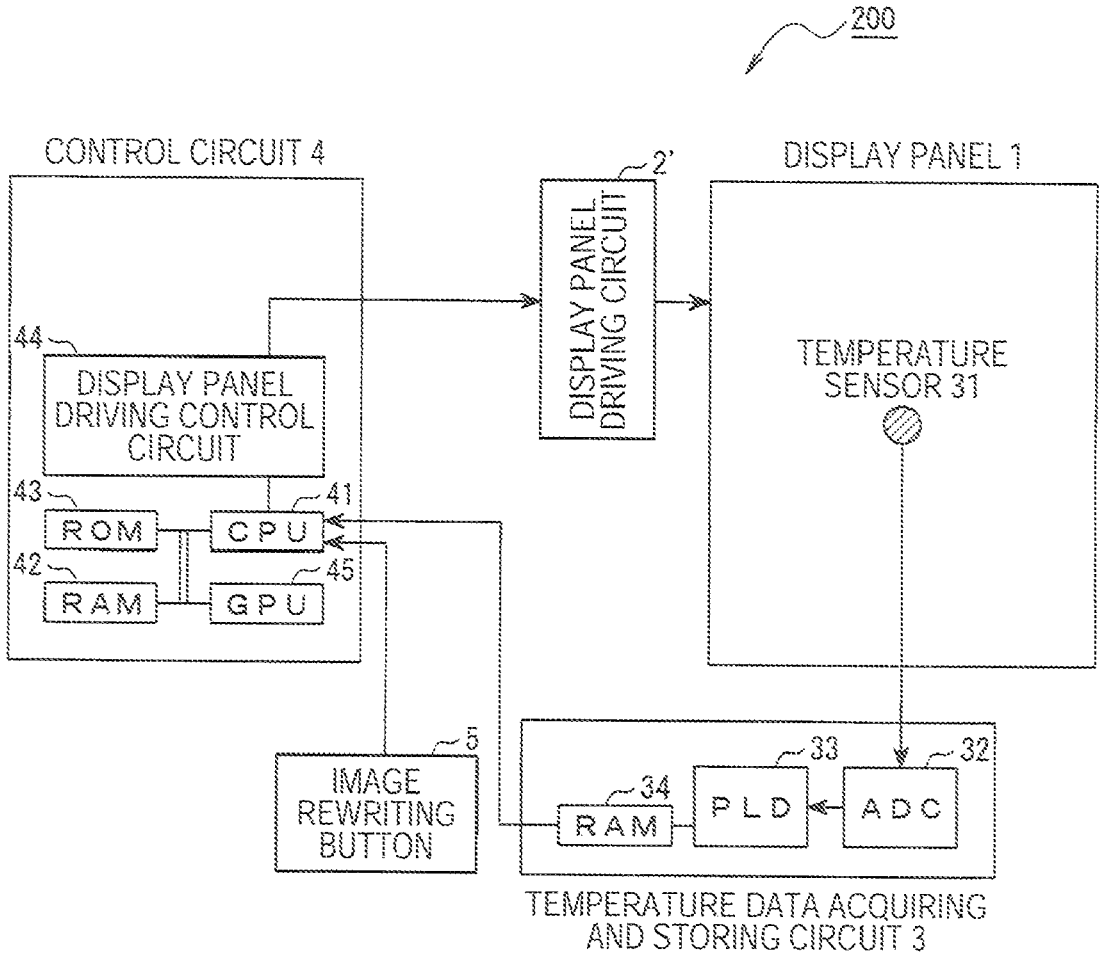
FIG. 11 is a block diagram showing an internal configuration of an image display device according to a first modified example.

Now, an image display device according to the first modified example will be described. FIG. 11 is a block diagram showing an internal configuration of an image display device 200 as a first modified example. As shown in FIG. 11, the image display device 200 of the first modified example has the substantially same configuration and operation as the image display device 100 of the first embodiment, but differs from the image display device 100 in that the image display device 200 includes an image generating unit (GPU) 45 as a control circuit 4 so as to generate the image data in accordance with the set gamma value.

The image display device 100 stores the image data generated beforehand by the external (for example, personal computer) in the predetermined area within the ROM 43, but the image display device 200 stores a text data (ASCII code base) as a character information of a content or a layout information during displaying the text data in the ROM 43. The GPU 45 generates (rendering) the image data to be displayed on the basis of such information and the gamma value determined by the CPU 41 and stores in the RAM 42. At this time, the image data of each pixel is generated in accordance with the gamma value so that the display gradation value prescribed by the set gamma value becomes the predetermined value depending on the pixel gradation value.

Figure 8:
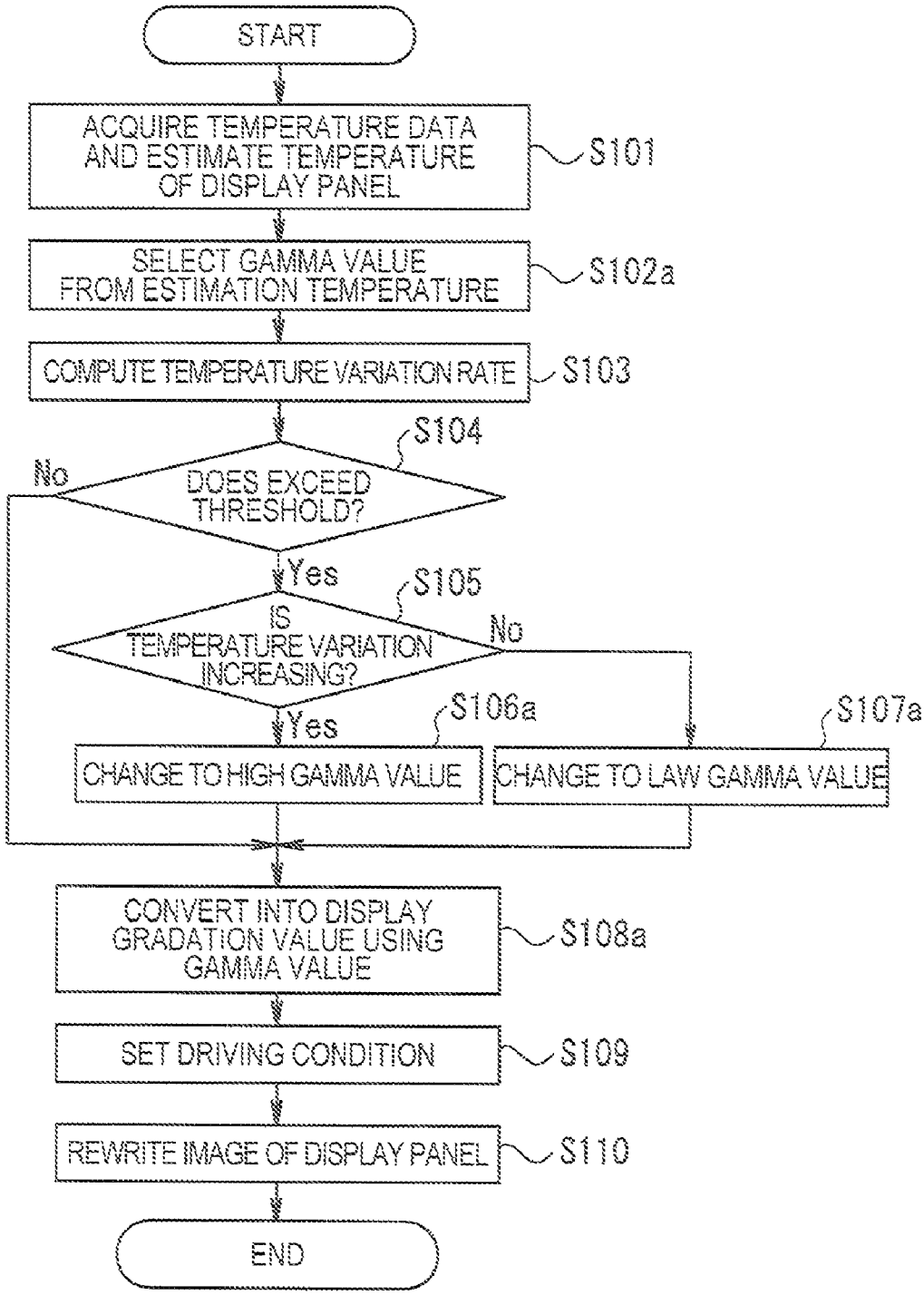
FIG. 8 is a flowchart explaining an operation of a second example of the image display device.

For example, when the second example shown in the flowchart of FIG. 8 performs the process of this modified example, the image data is generated in step S108*a* so that the display gradation value after the conversion becomes the predetermined display gradation value. As an example, when the display gradation value Y converted by the set gamma value is (0, 1/9, 4/9, 1) in advance, the image data is generated so that the pixel gradation value X becomes (0, 1/9, 4/9, 1) when the set gamma value is 1 and the pixel gradation value X becomes (0, 1/3, 2/3, 1) when the set gamma value is 2.

As for the generation process of the image elate, for example, when the set gamma value is 2 about the pixel of which the original pixel gradation value X is (1/3), the gradation value of the image is generated so that the pixel gradation value X is (1/3). In this manner, the display gradation value after the conversion becomes (1/9) that is the predetermined display gradation value.

Meanwhile, when the set gamma value is 1, since the display gradation value Y corresponding to the pixel of the pixel gradation value X (1/3) is coincidentally converted into (1/3), the display gradation value becomes different from the predetermined display gradation value. Here, it selects the display gradation value that corresponds to the selection voltage having the effective voltage value closest to the display gradation value (1/3). In FIGS. 4A and 4B described above, according to this modified example, assuming that the selection voltage V7 corresponding to the display gradation value (4/9) has the effective voltage value closest to the selection voltage V5, since the gamma value is 1, the pixel gradation value (1/3) is changed into the change pixel gradation value (4/9) equal to the display gradation value. That is, when the gamma value is 1, the gradation value data of the pixel is generated so that the gradation value of the pixel having the original gradation value of (1/3) becomes (4/9).

The process described above is performed about the gradation value data of all pixels, and the pixel gradation value of each pixel is changed into the change pixel gradation value. For this reason, it is possible to specify the kind of the driving voltage waveform. In addition, in the process of the image generating unit 45 described above, the predetermined display gradation values have fixed values such as (0, 1/9, 4/9, 1). However, as shown in FIG. 9, when the kind of the selection voltage to be selected is small, it is possible to reduce the kind of the driving voltage waveform. Accordingly, it is natural that the value having the range width of which one selection voltage is selected may be the predetermined display gradation value.

Then the CPU 41 transmits the image data stored in the RAM 42 to the display panel driving control circuit 44. Moreover, the display panel driving control circuit 44 transmits the specified selection voltage that is selected in respond to the display gradation value to a display panel driving circuit 2' in synchronization with the driving timing after converting the received image data and the gamma value into the predetermined display gradation value.

The display panel driving circuit 2' includes a PWM circuit in which a data driver can conduct four types of PWM outputs in accordance with 2-bit data input and drives the display panel 1 by generating the driving voltage waveform having the pulse width based on the selection voltage. For this reason, the display panel driving circuit 2' is different from the display panel driving circuit 2 in the image display device 100. Other operations are as shown in the flowchart of FIG. 8.

As described above, according to the embodiment described above, the driving voltage waveform having the pulse width like the display gradation value prescribed by the set gamma value is applied to the pixel without changing the correspondence relationship between the gradation value data of each pixel and the pixel gradation value, and it is possible to obtain the proper gradation display in accordance with each pixel. Meanwhile, according to the first modified example, the correspondence relationship between the gradation value data of each pixel and the pixel gradation value is changed, and the display gradation value prescribed by the set gamma value becomes the predetermined value. Therefore, in the first modified example, even in the small kind number of driving voltage waveforms, it is possible to obtain the proper gradation display in accordance with each pixel.

In addition, like the image display device 100 of the embodiment shown in FIG. 1, in case where the display panel driving circuit 2 is configured so as to generate the driving voltage waveform having the kinds more than the number of gradation display of the image displayed on the display panel 1, there has the advantage of being able to apply the invention to even a general-purpose image data having a number of gradation displays. In addition, like the image display device 200 of the first modified example shown in FIG. 11, even in case where the display panel driving circuit 2' is configured so as to generate only the driving voltage waveform having the same kind as the number of gradation display of the image data, for example, when the image display device is configured so as to conduct the rewriting of the display by communication-connecting between the personal computer and the display, there has the advantage of being able to apply the invention. That is, it is possible to generate the image data by GPU of the personal computer.

SECOND MODIFIED EXAMPLE

According to the example described above, the effective voltage value is not changed during the rewriting process on the display panel 1 in the image rewriting process (step S110 in FIG. 5, FIG. 8, and FIG. 10) of the display panel. However, when the temperature variation is considerably intense, the temperature of the display panel 1 very deviates from the estimation temperature on the rewriting. Here, according to this modified example, the effective voltage value may be changed at least once during the rewriting process of the image. The process of this modified example applied to the first example will be described with reference to the flowchart of FIG. 5.

When this modified example is applied, it is preferable that the comparing threshold value is set to a large value in step S104 of FIG. 5. That is, when it is determined that the absolute value of the temperature gradient exceeds the threshold value (step S104: YES), when the temperature is arise state (step S105: YES), the temperature variation sharply increases. Accordingly, there is strong probability that the temperature of the display panel 1 is higher than the estimation temperature while rewriting the image. Here, in step S106, it is conducted the selection process of the correspondence table that takes the estimation temperature estimated in step S101 as a temperature at the driving incipient, takes the second estimation temperature in which this estimation temperature is changed higher as a temperature during the driving of the display panel 1, and takes parameter temperatures in which these two estimation temperatures are respectively changed lower.

Meanwhile, when the temperature is a fall state (step S105: NO), the temperature variation sharply decreases. Accordingly, there is strong probability that the temperature of the display panel 1 is lower than the estimation temperature while rewriting the image. Here, in step S107, it is conducted the selection process of the correspondence table that takes the estimation temperature estimated in step S101 as a temperature at the driving incipient, takes the second estimation temperature in which this estimation temperature is changed lower as a temperature during the driving of the display panel 1, and takes parameter temperatures in which these two estimation temperatures are respectively changed lower.

According to this modified example, the second estimation temperature uses the hysteresis temperature measured by the temperature sensor at the time shorter than the prescribed time by a predetermined time in FIG. 6 described above. It is preferable that the shortened predetermined time is set in accordance with the magnitude of the threshold value to be set or is set in accordance with the time that is actually set as the selection period during the rewriting process of the image.

By using two correspondence tables selected as described above, two driving conditions are set in response with the display gradation value that is converted to be set in step S108 (step S109). Then, the image rewriting process (step S110) of the display panel is to change the driving condition at the driving incipient of the display panel 1 into the second driving condition during the driving. For this reason, it is possible to change the driving condition into the driving condition adapted to the temperature of the display panel 1 in the time passed from the driving incipient, and it is possible to conduct the temperature compensating process of higher precision.

In addition, it is preferable that the change timing of the driving condition is a point of time that rewrites half almost the image, when the change frequency is one time. It is natural that the change frequency is not limited to one time, and the change frequency may be set in accordance with the temperature variation rate.

OTHER MODIFIED EXAMPLE

In addition, the invention is not limited to the embodiments or the examples, and the first modified example described above but is embodied as the following modified example. For example, although the above embodiments describe the image display device that is driven by the DDS driving system using the cholesteric liquid crystal as a display material, the invention may include the image display device using other display material (for example, a memory type display material of an electrophoresis) having an intense temperature characteristic. In addition, the cholesteric liquid crystal may be applied to the driving system of a conventional driving as a driving system.

In addition, the detection of the temperature gradient is not limited to the method of detecting on the basis of time-series data of the temperature. For example, by measuring the temperature of members having a different thermal conductivity among the members forming the image display device, the temperature gradient maybe detected on the basis of the temperature difference of the members. That is, when the variation rate of environmental temperature is small and the temperature of the display panel is scarcely varied, it is possible to estimate that the temperature of each member is approximately equal to the environmental temperature. However, when the environmental temperature is varied, since the temperature of the member having high thermal conductivity is varied ahead, the temperature difference between the members occurs. Accordingly, it is possible to detect the temperature variation rate on the basis of thus temperature difference.

In addition, according to the embodiment described above, an applied time is changed by changing the pulse width of the driving voltage waveform in the selection period, and the effective voltage value is applied to the pixel in accordance with the gradation to be displayed. However, the effective voltage value may be changed by changing the applied voltage value to be an amplitude of the driving voltage waveform without changing the pulse width. Alternatively, both the applied time and the applied voltage may be changed. In this manner, it is possible to generate the driving voltage waveform having plural kinds of effective voltage values by combining the applied time and the applied voltage.

In addition, according to the third example in the embodiment described above, when the display panel driving control circuit 44 converts the pixel gradation value into the display gradation value on the basis of the gamma value, the pixel gradation values (0, ⅓, ⅔, and 1) of four gradations are changed into two kinds of pixel gradation values (0, 1) in advance. Naturally, the third example is not limited thereto, but may be embodied in the first example. For example, in the correspondence table TA shown in FIG. 7, it may be prescribed so that the pixel gradation value (0, ⅓) corresponds to the display gradation value (H0) and the pixel gradation value (⅔, 1) corresponds to the display gradation value (H15) in total parameter temperatures. In this manner, it is possible to easily change into two kinds of pixel gradation value (0, 1).

In addition, according to the third example in the embodiment, when the pixel gradation value is converted into the display gradation value, the pixel gradation values (0, ⅓, ⅔, and 1) of four gradations are changed into two kinds of pixel gradation values (0, 1) showing "black" and "white" in advance, but is not limited thereto. For example, the pixel gradation value (0, ⅓) may be changed into the pixel gradation value (1/9), and the pixel gradation value (⅔, 1) maybe changed into the pixel gradation value (8/9). As described above, the reflectance or transmittance of the display panel 1 is different according to the characteristics of the display material to be used. Therefore, it is preferable to change beforehand into the pixel gradation value in accordance with the preferred gradation display depending on the characteristics of the display material.

In addition, according to the embodiment described above, the temperature compensating process is conducted to the image in which the pixel gradation value is represented by the standardized reflectance (0, ⅓, ⅔, 1) of four gradation, but is not particularly limited thereto. For example, it is possible that the invention is similarly applicable to the image in which the pixel gradation value is many as much as 8-gradation or the image in which the pixel gradation value is less as small as by 3-gradation. Furthermore, the pixel gradation value may not be limited to the interval of the approximately equal standardized reflectance such as (0, ⅓, ⅔, and 1).

In addition, according to the embodiment described above, the number of the selection voltages are 16 kinds (V0 to V15), but may be other kind-number (for example, 256 kinds: V0 to V255). The kind-number of the selection voltage may be set in accordance with the pulse width changeable number of the PWM circuit or the number of voltage values of the applied voltage.

In addition, the image display device 100 of the above embodiment or the image display device 200 of the first modified example may be integrally configured with the above components. Moreover, the image display device 100 or the image display device 200 may be configured so as to cooperatively achieve the aspect of the invention by connecting communicatively the plural devices in which the above components are separately mounted. For example, in FIG. 1, it may be an image display device configured by a client device provided with the display panel 1, the temperature data acquiring and storing circuit 3, and the display panel driving circuit 2 and a host device (personal computer) provided with at least a part of the function of the control circuit 4. In this case, the function is achieved by transmitting and receiving mutually the temperature information and the image data.

The entire disclosure of Japanese Patent Application Nos. 2006-101947, filed Apr. 3, 2006 and 2007-69897, filed Mar. 19, 2006 are expressly incorporated by reference herein.

What is claimed is:

1. An image display device for displaying an image on a display panel, the image display device comprising:

a temperature variation rate detecting unit that detects and calculates a temperature variation rate based on a temperature of the display panel measured by a temperature sensor and a temperature of a display material calculated from a prescribed time at which a temperature of the display material will achieve the temperature measured by the temperature sensor;

a driving condition setting unit that sets driving conditions so as to display the image on the display panel in accordance with an image data of the image;

a driving condition changing unit that changes the set driving conditions in accordance with the detected temperature variation rate; and a display panel driving unit that displays the image on the display panel by driving the display panel with the driving conditions changed by the driving condition changing unit.

2. The image display device according to claim 1, wherein the driving condition changing unit changes the driving conditions during driving of the display panel.

3. The image display device according to claim 1, further comprising a gradation setting unit that sets so as to change an image gradation value as an image data of a pixel configuring the image into a display gradation value as an image data of a pixel configuring the image displayed by the display panel driving unit in accordance with the detected temperature variation rate, wherein the driving condition changing unit changes the set driving conditions into the driving conditions on which the driving condition setting unit sets the changed and set display gradation value as an image data.

4. The image display device according to claim 3, wherein when the temperature variation rate exceeds a threshold value, the gradation setting unit changes and sets the pixel gradation value into the display gradation value so that the number of gradation display of the image to be displayed is small as compared that in case where the temperature variation rate is not more than the threshold value.

5. The image display device according to claim 3, wherein the gradation setting unit changes and sets the pixel gradation value into the display gradation value on the basis of a table that prescribes a correspondence relationship between the pixel gradation value and the display gradation value.

6. The image display device according to claim 5, wherein when the temperature variation rate exceeds a threshold value, the gradation setting unit sets a display gradation value that differs from the display gradation value when the temperature variation rate is not more than the threshold value.

7. The image display device according to claim 4, further comprising an image generating unit that generates a changed pixel gradation value of which the pixel gradation value is changed such that the pixel gradation value is converted into a predetermined display gradation value, wherein the gradation setting unit changes and sets the changed pixel gradation value as the pixel gradation value.

8. The image display device according to claim 1, further comprising a temperature measuring unit that measures a temperature of the display panel, wherein the driving condition setting unit sets the driving conditions in accordance with the measured temperature of the display panel in addition to the image data.

9. The image display device according to claim 1, wherein the driving condition setting unit sets driving conditions based on the image data from the driving conditions having the number not less than the number of gradation displays of the image displayed on the display panel.

10. The image display device according to claim 1, wherein the display material of the display panel is a liquid crystal material showing a plurality of final alignment states having different molecular alignments in a final image display state, and wherein the display panel driving unit drives the display panel by using a driving system that selects the final alignment state in a selection period after transiting an alignment state of the molecular alignment into a transition alignment that differs from the final alignment state.

11. The image display device according to claim 10, wherein the display panel utilizes a cholesteric liquid crystal molecular as the display material.

12. An image display method of displaying an image on a display panel, the method comprising:

detecting a temperature variation rate of the display panel by measuring a temperature of the display panel with a temperature sensor and calculating a temperature of a display material from a prescribed time at which the temperature of the display material will achieve the temperature measured by the temperature sensor;

setting driving conditions so as to display the image on the display panel in accordance with an image data of the image;

changing the set driving conditions in accordance with the detected temperature variation rate; and displaying the image on the display panel by driving the display panel with the driving conditions changed by the driving condition changing unit.

13. The image display device according to claim 1, wherein the display material of the display panel is an electrophoretic material.

14. The image display device according to claim 12, wherein the display material of the display panel is a liquid crystal material or an electrophoretic material.

* * * * *